United States Patent [19]

Wittrisch

[11] Patent Number: 5,044,437

[45] Date of Patent: Sep. 3, 1991

[54] METHOD AND DEVICE FOR PERFORMING PERFORATING OPERATIONS IN A WELL

[75] Inventor: Christian Wittrisch, Rueil-Malmaison, France

[73] Assignee: Institut Francais du Petrole, Rueil Malmaison, France

[21] Appl. No.: 541,016

[22] Filed: Jun. 20, 1990

[30] Foreign Application Priority Data

Jun. 20, 1989 [FR] France ..... 89 08309

[51] Int. Cl.[5] ..... E21B 43/119

[52] U.S. Cl. ..... 166/250; 166/55.1; 166/66; 166/113; 166/254; 166/297; 166/385; 175/4.51; 175/4.52

[58] Field of Search ..... 166/250, 55, 55.1, 66, 166/64, 297, 385, 254, 65.1; 175/4.51, 4.52, 4.53

[56] References Cited

U.S. PATENT DOCUMENTS

| | | | |
|---|---|---|---|
| 3,426,850 | 2/1969 | McDuffie, Jr. | 175/4.51 |
| 3,704,749 | 12/1972 | Estes et al. | 175/4.51 |
| 4,349,072 | 9/1982 | Escaron et al. | 166/297 |
| 4,375,834 | 3/1983 | Trott | 175/4.51 |
| 4,484,628 | 11/1984 | Lanmon, II | 166/297 |
| 4,485,870 | 12/1984 | Walulik | 166/297 |
| 4,488,597 | 12/1984 | Hoppe et al. | 166/385 |
| 4,544,035 | 10/1985 | Voss | 166/55.1 |
| 4,633,945 | 1/1987 | Upchurch | 166/55.1 |
| 4,664,189 | 5/1987 | Wittrisch | 166/385 |
| 4,690,218 | 9/1987 | Sumner | 166/55.1 |
| 4,790,383 | 12/1988 | Savage et al. | 166/297 |

FOREIGN PATENT DOCUMENTS 0288239 10/1988 European Pat. Off. .

*Primary Examiner*—Bruce M. Kisliuk

*Attorney, Agent, or Firm*—Antonelli, Terry, Stout & Kraus

[57] ABSTRACT

A method and device for perforating a wall of a well by use of a tool such as an explosive gun includes the use of an intervention set. This set has a perforating tool associated with a measuring box such as a logging sonde and temperature and pressure sensors which is taken down into the well. The set is suspended by a linking cable on a support frame which can be locked inside and at the base of a tubing. The tubing is taken down to the intervention area and blocked by a packer. The support frame and the set are displaced by a control cable lowered down from the surface and the best places for carrying out shootings or perfortions in the well are determined through measurements made by the measuring box. Sensors contained in the box allow an operator to check the results. After the intervention, the perforating tool, for example, an explosive gun, is left in the well and the support frame and the box are taken up in order to clear the inside of the tubing.

11 Claims, 3 Drawing Sheets

METHOD AND DEVICE FOR PERFORMING PERFORATING OPERATIONS IN A WELL

BACKGROUND OF THE INVENTION

The present invention relates to a method and a device for performing perforating operations in a well and notably a well destined for oil production.

According to a method which is well-known by drilling specialists, bringing an oil well into production is achieved by taking down into a cemented well a tubing of a section smaller than that of the well. A perforating tool such as a gun containing one or several explosive charges is fastened at its base through removable connecting means. The tubing is equipped towards its lower part with a preventer stack such as a packer the dilatation of which, controlled from a surface installation, allows to close the annular space between the wall of the well and the tubing and to immobilize the latter when the gun has reached the required depth. The triggering of the gun is carried out by taking down into the tubing a percussion bar adapted for striking a detonator at the top of the gun, through the opening of a valve allowing to apply a hydraulic overpressure which is imposed in the tubing, or else through an electric igniting by taking down a female electric connector to a complementary connector disposed in the upper part of the gun. When the well begins to produce, owing to the performed perforatings, the total lower part of the tubing below the packer is removed in order to clear the passageway to the surface and this part falls to the well bottom. Specialists often call these perforating systems TCP (tubing conveyed perforating) systems.

Different systems of this type have been described, among other examples, in U.S. Pat. Nos. 4,633,945 or 4,756,371, or in European Patent Application 288,239.

In such a perforating system, the distance between, the packer and the gun is often several meters (e.g., more than 20 meters) owing to stiff tubular sections interposed between both of them. It is thus obligatory to drill an additional well portion or "rathole" much beyond the depth where the perforatings will take place, so that the perforating system can fall down into this portion and the lower end of the tubing is cleared. Moreover, if several perforatings must be performed in one area of the well after the blocking of the packer, a perforating device with several stages spaced out from one another by tube sections must be used. The spacing must be selected in such a way that the perforatings occur at the wanted depths. This complicates the operations for mounting the device at the tubing bottom. Besides, owing to the greater length of the perforating device, the additional well length to be drilled in order to allow the gun to fall after use is greater.

U.S. Pat. No. 4,593,195 describes a device for bringing an intervention tool (such as a measuring sonde or a perforating gun) to the bottom of a well bore comprising a tubing fitted towards its lower end with an expansible packer, a support frame for the tool, disposed near the lower end of the tubing, a flexible linking element comprising an electric cable for linking the tool to its support frame and remote control means comprising a cable equipped with an electric connector that can be taken down along the tubing until it plugs into an additional connector carried by the support frame, in order to transmit electric control signals and/or tensile strains to provide the displacing of the tool.

SUMMARY OF THE INVENTION

The method according to the invention allows to perform perforating operations in a well such as an oil well bore for example, in conditions which facilitate in situ measurings before and after the perforating operations and the clearing of the well for bringing in the well. It comprises taking down into the well to the area to be perforated a tubing of a section smaller than that of the well, equipped towards its lower part with an outer expansible packer allowing to close the annular space between the well and the tubing and to immobilize the latter, a perforating tool connected by a linking element to a support frame which can be displaced within said tubing, this set being fitted with connecting means allowing to set up an electric connection between said linking element and an electric connector taken down from a surface installation at the end of a control cable. The method is characterized by:

the adding of a measuring set permanently connected to the linking element and displaceable with the perforating tool, and of fastening means that can be removed by remote control, allowing the separation between said linking element and the perforating tool, the displacing of the measuring set in the well below said tubing through an action on the linking element and the performing of measuring cycles allowing to determine at least one location where the perforating tool should be activated, the release of the perforating tool at each determined location, the separation between the linking element and the perforating tool, and the clearing of the tubing by taking up the support frame and the linking element which is fastened to it.

The method according to the invention can also comprise a stage of measurement of the state parameters by said measuring set after the release of said perforating tool.

The device according to the invention comprises a tubing of a section smaller than that of the well, equipped towards its lower end with an outer expansible packer allowing to close the annular space between the well and the tubing and to immobilize the latter, motor means for taking the tubing down to the area to be perforated, a perforating tool, a support frame that can be displaced within said tubing, a linking element connecting the perforating tool to said support frame, a control cable that can be unwound from a surface installation to said support frame, connecting means allowing, at the chosen depth, to interconnect the control cable to the perforating tool by means of said linking element. It is characterized by:

a logging set connected to said linking cable, allowing, through the displacement of the support frame, to determine at least one location to be perforated, and removable fastening means allowing to unfasten the perforating tool from the linking element at the end of the perforating operations.

The device according to the invention comprises for example locking means that can be removed by remote control from the surface installation, in order to immobilize the translation movement of the support frame in relation to the tubing in at least one location of the latter. This location can be above the packer or between the location of the packer and the lower end of the tubing. A lower stop ring can optionally be combined with the tubing.

The device can also comprise at the same time removable means for locking the support frame in relation to the tubing in a higher position and a stop ring attached to the tubing serving as a support for the support frame when the latter is in a lower position, the support frame being displaceable in the tubing between these two positions.

According to a preferred embodiment, the device comprises means for measuring the conditions which prevail in the part of the well below the packer, such as the temperature and the pressure.

According to another embodiment, the device can comprise means for intermittently isolating from one another the parts of the tubing on either side of the support frame, in order to benefit during the perforating operations from the difference of pressure on either side.

The device according to the invention and its implementing method show several advantages:

Since the perforating tool can be displaced in relation to the tubing at the end of a connecting cable, the additional well portion to be drilled below its lowest position in order to allow its falling and the clearing of the lower end of the tubing is shorter than with the prior systems. It is also possible to utilize a perforating tool with several charges that can be selectively released and thus, by displacing the tool, to successively carry out several perforating operations at different depths. The implementing of perforating operations is much more flexible than with guns where the charges are stepped at fixed intervals from one another.

This advantage is still increased by the fact that preliminary measurings such as correlation loggings can be carried out, by means of which the depths where the tool must be released can be precisely determined. Its positioning is thus simply obtained by displacing the support frame in relation to the tubing immobilized in the well.

The measuring set fastened to the linking element also allows to carry out production loggings (temperature and pressure measurings for example) along the part of the well under the tubing.

Besides, the isolation of the part of the tubing on either side of the support frame allows to benefit from the generally lower pressure which prevails in the tubing, in order to clean the perforations obtained by releasing the tool.

BRIEF DESCRIPTION OF THE DRAWINGS

Other features and advantages of the method and the device according to the invention will be clear from reading the description of several embodiments hereafter given by way of non limitative examples with reference to the accompanying drawings in which.

DESCRIPTION OF THE PREFERRED EMBODIMENTS

Figure 1:
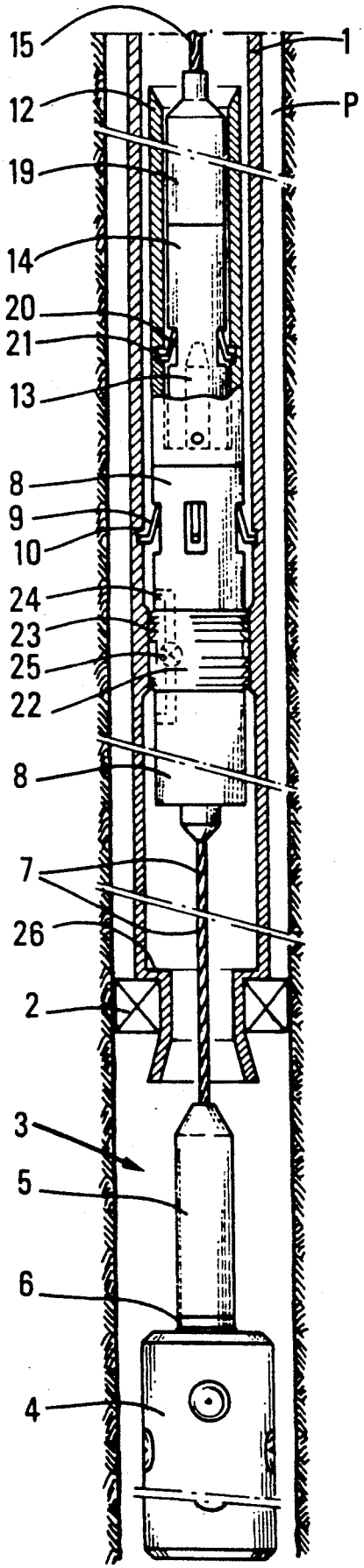
FIG. 1 shows a diagram of a first embodiment of the device where the perforating tool or gun is connected to the corresponding support frame by a connecting cable.

In order to perform perforating operations in a well (P), a tubing 1 fitted towards its lower end with an expansible sealing element 2 such as a packer of a well-known type is lowered down into the well. The packer can be expanded on request until it locks against the wall of the well and immobilizes tubing 1. An intervention set 3 comprising a perforating tool or gun 4 of a well-known type topped by a box 5 containing a measuring set is attached at the lower end of the tubing. The section of box 5 is selected so that it can pass across the opening at the base of the tubing.

The gun 4 comprises one or several explosive charges which can be selectively released by applying an electric control signal.

The measuring set in box 5 comprises signal emission-reception means allowing for example to carry out correlation loggings which can be compared to recordings previously obtained in the well. These means comprise for example a gamma sonde. The measuring set also advantageously comprises means for carrying out logs known as production logs allowing the set to measure parameter values such as the temperature and the pressure of the fluids stemming from the surrounding formations. Box 5 is connected to the gun by removable connecting means 6. Anchoring fingers (not shown) which are drawn apart through the action of an electric motor and disconnect the gun 4 from box 5 are used for example. It is also possible to utilize equivalent means such as explosive bolts.

In the embodiment of FIG. 1, the box is fastened to a first end of an electric carrying cable 7. The opposite end of cable 7 is connected, within tubing 1, to a support frame 8 of a section smaller than that of the tubing. Anchoring fingers 9 are mounted to pivot in relation to support frame 8. Through the action of a motor which is not shown, the fingers can be moved apart to an open position where they are locked in a groove 10 arranged in the inner wall of tubing 1. The support frame comprises, opposite to cable 7, a tubular extension 11 ending in a cupped collar 12. A multicontact plug 13 is disposed in the center of the tubular extension 11 and following its axis. The collar 12 serves for guiding towards plug 13 a mating female plug 14. The plug 14 is connected to the various conductors of a control cable 15 connected to a surface installation 16 (FIG. 3) comprising maneuvering means 17 and a set 18 for controlling and recording the data collected by the measuring set in box 5. The female plug 14 is topped by a tubular weighting bar 19 of a substantially equal section. Plug 14 also comprises anchoring fingers 20 of a well-known type which can be moved apart through the action of electromagnetic means or of an electric motor. Slots 21 for the fingers 20 are arranged in the inner wall of the tubular extension 11. The fingers can fit therein when plug 13 is in a correct plugging position. The locking of fingers 20 allows the translation of support frame 8 through the pulling exerted on cable 15 by the surface lifting means. Inside the support frame, conductors (not shown) provide the electric interconnection of cables 7 and 15.

Examples of electric connectors using this type of multicontact plug and mating female plug are for example described in U.S. Pat. No. 4,500,155.

Figure 3:
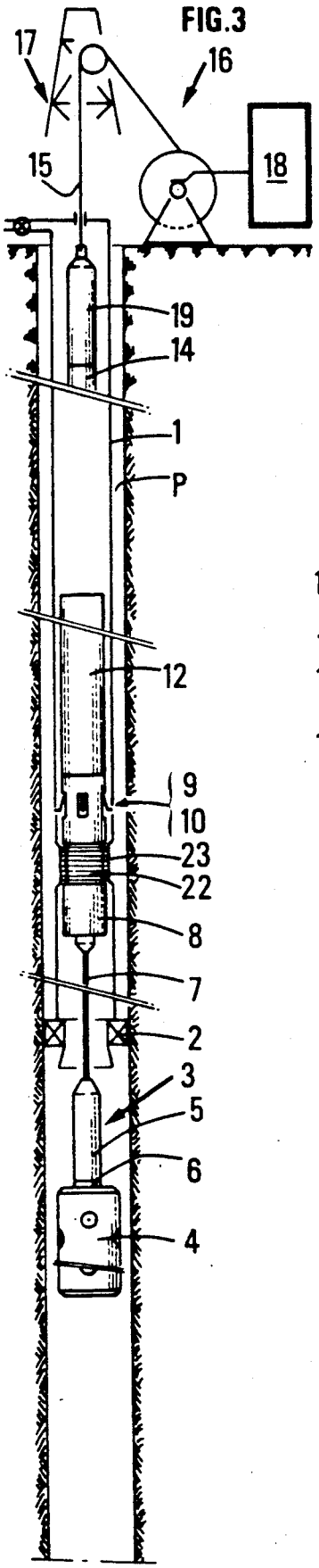
FIG. 3 shows a first stage of the setting and the anchoring of the tubing in a well with the gun at its base.
Figure 4:
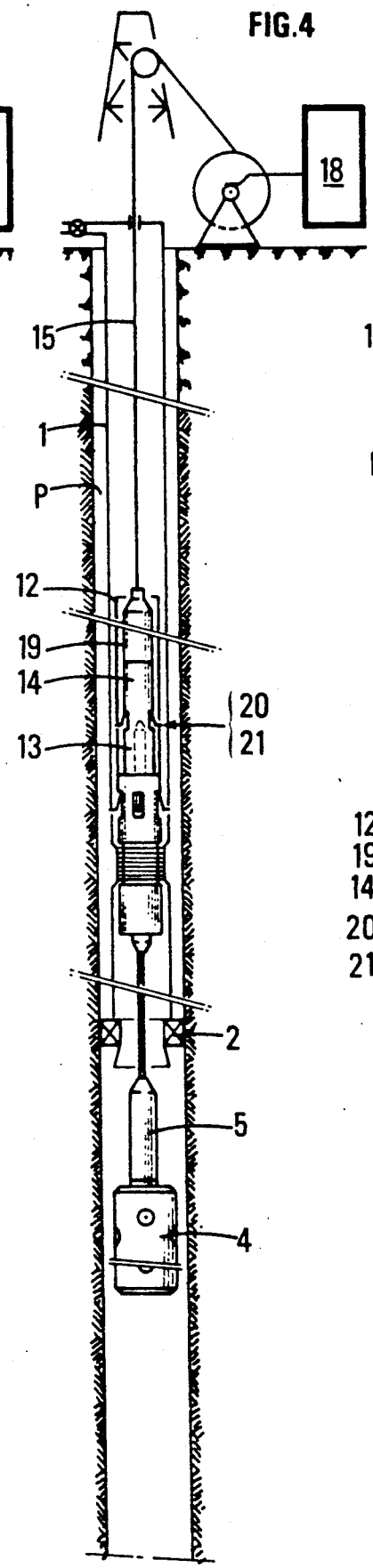
FIG. 4 shows a second stage where the gun is connected to the surface installation by a control cable.
Figure 5:
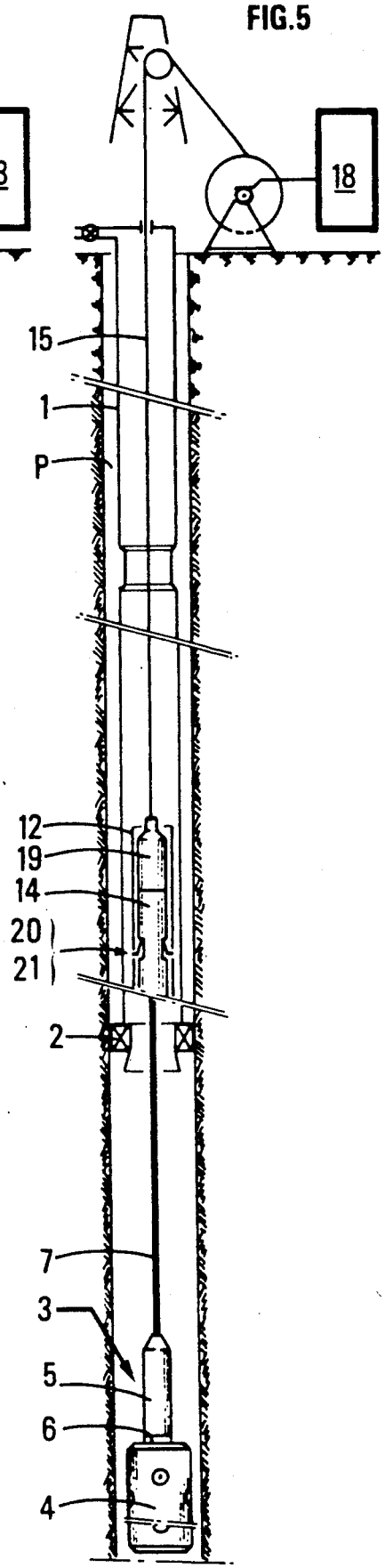
FIG. 5 shows a third stage where the gun is taken down in the well below the tubing.

A set of elastic cups 22 is arranged around support frame 8. The section of tubing 1, which locking groove 10 lies in, is equipped with a rectified wall portion 23. When support frame 8 is in the locking position as shown in FIG. 1, the set of cups 22 is in contact with this rectified portion 23 and tightly separates the parts of the tubing on either side. Inside support frame 8, a side channel 24 closed by a valve 25 the opening of which can be remote controlled from control set 18 is arranged (FIG. 3). Channel 24 connects the two opposite sides of the set of cups 22. Pressure pick-ups can be included in the support frame in order to measure the pressures prevailing on either side of the set of cups 22.

In the embodiment of FIG. 1, the terminal section of tubing 1 is too narrow for support frame 8 to pass across. The stroke of the latter thus entirely occurs within the tubing from the shown higher position to a lower position delimited by a lower stop ring 26. This stroke is adapted to the displacement latitude which is wanted for intervention set 3.

Figure 2:
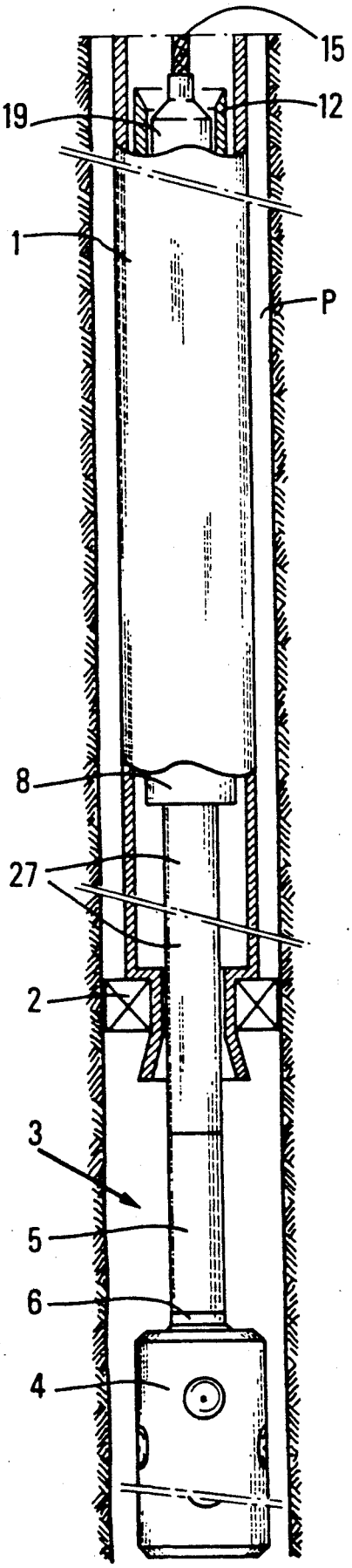
FIG. 2 shows a diagram of a second embodiment where the same gun is connected to its support frame by a tubular linking element.

In the embodiment of FIG. 2, the section of the well and/or the packer 2 which is utilized allow the use of a tubing without any terminal diameter restriction. In this case, support frame 8 can freely come out of tubing 1 and follow the descent of intervention set 3 towards the base of well P. The linking between box 5 and support frame 8 can be provided by a rigid connection such as a tube 27 (a case represented in FIG. 2) or else by a cable as previously.

The operations for perforating a well with the device described above are performed as follows:

The linking element (cable 7 or tube 27) associated with an intervention set 3 consisting of the gun 4 and the logging box 5 is introduced into the terminal section of tubing 1 fitted with a packer 2 and mechanically and electrically connected to the base of support frame 8. The latter is positioned in the tubing so as to allow the fingers 9 to fit into groove 10 and to put the set of cups 22 in contact with the rectified portion 23. Valve 25 is closed.

Intervention set 3 with its support frame 8 locked in tubing 1 is taken down into the well and tubing sections are progressively added in order to bring it to the area of the well where the operations will be performed. Packer 2 is then anchored by expansion against the wall of the well (FIG. 3).

Plug 14 topped by its weighting bar 19 is then taken down into the well at the end of control cable 15 until it plugs into multicontact plug 13. The locking of fingers 20 in their slots 21 is then effected. Plug 14 goes down into the tubing by gravity or is propelled by a fluid current as described in French Patent 2,547,861.

The well is most often filled with water whereas tubing 1 is partly empty. Therefore, the pressures that prevail towards its base on either side of the set of cups 22 are unequal. This difference can otherwise be adjusted by filling more or less of the tubing with water and the operation is facilitated if pick-ups have been integrated in support frame 8 to measure the pressures prevailing on either side of the set of cups 22. The base of the well being isolated by the locking of packer 2, valve 25 is opened in order to equalize the pressures on either side.

Fingers 9 which hold support frame 8 in a higher position 20 are then unlocked and maneuvering means 17 are activated in order to take the intervention set down towards the bottom of well P.

Intervention set 3 is then progressively taken up and the running of the logging sonde contained in box 5 is controlled from set 18 at the surface. The obtained recordings are compared at the surface with other recordings which have been previously achieved in the same area. By correlation, it is possible to find the most judicious position or positions for carrying out the perforating operations.

Gun 4 is brought to the required depth and the explosion of a charge is electrically triggered. The pressure and temperature sensors which are advantageously included in box 5 act to check the results of the explosion. The depression caused in the lower area of the well following the opening of valve 25 (FIG. 1) enables an operator to clear the performed perforations by suction of the cuttings out of the subterranean formations.

When several perforating operations must be carried out, the gun is successively brought to the depths located by correlation and the explosions are released.

When the perforating operations are finished, the tubing is cleared. To that effect, gun 4 is unfastened from the box of tools 5 and maneuvering means 18 are activated from the surface in order to take it up with support frame 8. The gun falls to the bottom of the well.

Figure 6:
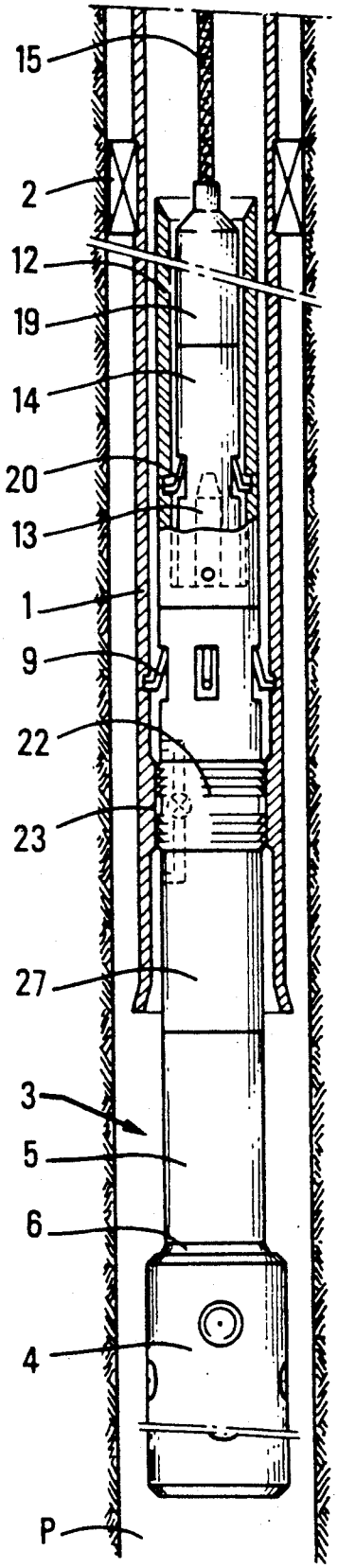
FIG. 6 shows a third embodiment where the support frame of the gun is locked at the tubing below the packer and can get out of the tubing when the gun is taken down towards the base of the well.

According to the embodiment of FIG. 6, the terminal section of tubing 1 containing the locking means 9, 10 of support frame 8 is added below the section carrying the anchoring packer 2 and the selected linking element (cable 7 or tube 27) is adapted to the section of the tubing at the level of packer 2.

Figure 7:
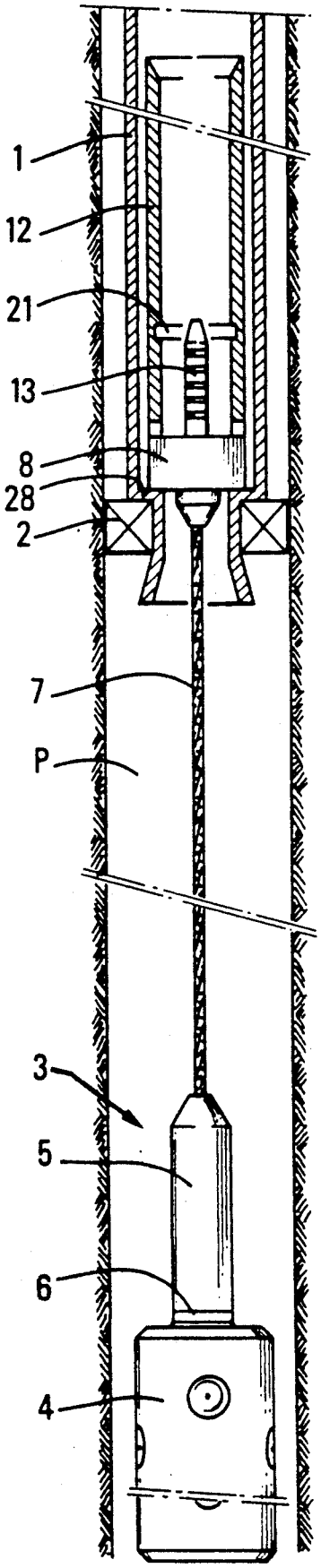
FIG. 7 shows a fourth embodiment where the support frame is simply retained by a low stop ring towards the end of the tubing.

According to the embodiment of FIG. 7, the tubing is fitted with a simple lower stop ring 28 which support frame 8 lies on. The intervention set is in the lower position a the end of its linking element 7, 27 during the total descent towards the intervention area. Its upright displacement is achieved after connecting and locking multicontact plug 13 taken down from the surface.

Using the embodiment of FIG. 7 as it is, without the intervention of a control cable 15 and thus without the possibility of displacing it, would remain within the scope of the invention. In this case, support frame 8 is equipped with a fastening head and can be recovered and taken up to the surface by a hook taken down at the end of a cable.

What is claimed is:

1. A method for performing perforating operations in a well extending downwardly through earth formations comprising: lowering down into a well to the area to be perforated (a) a tubing of a section smaller than that of the well, said tubing being externally fitted towards a lower portion thereof with an expansible packer, the expansion of which acts to close an annular space between the well and the tubing and to couple the tubing to surrounding earth formations;

(b) a support frame displaceable within said tubing, said frame being provided with a first locking means that is operated by remote control for releasably securing the support frame within the tubing; and (c) a mobile intervention system comprising a measuring set permanently connected with the support frame via a linking element, a perforating tool and detachable fastening means for attaching the perforating tool to the measuring set, said fastening means being detachable by remote control;

positioning inside a portion of said tubing from a surface installation a control cable connected with a connection means provided with a second locking means for releasably securing said connection means to the support frame;

releasing the intervention system by remote control of the first locking means and displacing the system within the well below said tubing;

effecting a series of measuring cycles by said measuring set to determine at least one location where the perforating tool must be operated;

actuating the perforating tool a determined location, thereby perforating the surrounding earth formation;

dropping the perforating tool into a lower portion of the well by actuating said fastening means to detach the perforating tool from the measuring set; and clearing the tubing by removing the support frame with the linking element and the measuring set connected thereto.

2. A method as claimed in claim 1, further comprising measuring pressures or temperatures prevailing in the well with said measuring set after the dropping of said perforating tool.

3. A device for performing perforating operations in a well extending downwardly through earth formations which comprises:

(a) a tubing of a section smaller than that of the well, said tubing being externally fitted towards a lower portion with an expansible packer, the expansion of which acts to close an annular space between the well and the tubing and to couple the tubing to surrounding earth formations;

(b) means for lowering the tubing into the well to an area to be perforated;

(c) a support frame displaceable within said tubing, said frame being provided with a first locking means operable by remote control for releasably securing the support frame within the tubing;

(d) a mobile intervention system comprising a measuring set permanently connected with the support frame via a linking element, a perforating tool and a detachable fastening means for attaching the perforating tool to the measuring set, said fastening means being operated by remote control;

(e) a control cable connected to a surface installation and to a connection means provided with a second locking means operated by remote control for releasably securing said connection means to the support frame so that said control cable is interconnected with said perforated tool via said linking element, said cable being displaceable within the well; and (f) control means located on the surface and connected to the control cable for effecting separation of the intervention system from the tubing by actuating said first locking means, for controlling the measuring set to determined at least one location in the surrounding earth formation to be perforated, for actuating said perforating tool to effect a perforating operation, and for actuating the fastening means to effect separation of the perforating tool from the measuring set, thereby allowing the perforation tool to drop into the well.

4. A device as claimed is claim 3, wherein the first locking means is operable to secure the support frame at a first position within said packer.

5. A device as claimed in claim 4, further comprising a stop ring attached to the tubing which serves as a support for the support frame in a second position of the frame, the support frame being displaceable in the tubing between said first position and said second position.

6. A device as claimed in claim 3, wherein the first locking means is operable to secure the support frame at a first position between a location of the packer and a lower end of the tubing.

7. A device as claimed in claim 6, further comprising a stop ring attached to the tubing which serves as a support for the support frame in a second position of the frame, the support frame being displaceable in the tubing between said first position and said second position.

8. A device as claimed in any one of claims 3 to 7, further comprising means for measuring pressure conditions prevailing in a part of the well below said packer.

9. A device as claimed in any one of claims 3 to 7, further comprising means for intermittently isolating parts of the tubing on either side of the support frame from one another.

10. A device as claimed in claim 3, wherein said linking means includes a multi-conductor cable.

11. A device as claimed in claim 3, wherein said linking means includes a rigid tube.

* * * * *